US010251504B1

(12) United States Patent
Sutton et al.

(10) Patent No.: US 10,251,504 B1
(45) Date of Patent: Apr. 9, 2019

(54) CHRISTMAS TREE DISPOSAL CASING

(71) Applicants: Harold Sutton, Franklinville, NJ (US); Rachelle Sutton, Franklinville, NJ (US); Millicent Davis, Sicklerville, NJ (US); Kevin Davis, Sicklerville, NJ (US)

(72) Inventors: Harold Sutton, Franklinville, NJ (US); Rachelle Sutton, Franklinville, NJ (US); Millicent Davis, Sicklerville, NJ (US); Kevin Davis, Sicklerville, NJ (US)

( * ) Notice: Subject to any disclaimer, the term of this patent is extended or adjusted under 35 U.S.C. 154(b) by 0 days.

(21) Appl. No.: 15/824,286

(22) Filed: Nov. 28, 2017

Related U.S. Application Data

(60) Provisional application No. 62/426,792, filed on Nov. 28, 2016.

(51) Int. Cl.
*B65D 85/50* (2006.01)
*A47G 33/04* (2006.01)
*B65F 1/00* (2006.01)

(52) U.S. Cl.
CPC ..... *A47G 33/045* (2013.01); *B65F 1/0006* (2013.01); *B65F 2240/124* (2013.01)

(58) Field of Classification Search
CPC ..... B65D 85/50; B65D 85/52; B65F 1/0006; B65F 2240/124; A47G 33/045
USPC ..... 206/423, 810; 383/2
See application file for complete search history.

(56) References Cited

U.S. PATENT DOCUMENTS 2,781,811 A * 2/1957 Dilar ..... A47G 33/045 206/423
2,911,025 A * 11/1959 Paros ..... A47G 33/045 206/423
3,312,263 A * 4/1967 Wahlstrom ..... A01G 20/30 383/119
4,054,166 A 10/1977 Burke
4,384,604 A 5/1983 DeLaura et al.
4,799,520 A 1/1989 Blackburn et al.
4,899,878 A 2/1990 Lofton
4,969,555 A * 11/1990 Fitzgerald ..... A01G 13/0237 206/423
5,291,999 A * 3/1994 Phair ..... A47G 33/045 206/423

(Continued)

FOREIGN PATENT DOCUMENTS

EP 1563771 8/2005
WO WO2005016086 2/2005

*Primary Examiner* — Jacob K Ackun
*Assistant Examiner* — Jenine Pagan

(57) ABSTRACT

A Christmas tree disposal casing, having an upper end and a lower end, and a first panel and a second panel that each have an inner edge, an outer edge, an upper edge, and a lower edge. The casing has a flat configuration and also has a sleeve configuration for encasing a tree therein when the first panel is joined to the second panel at or near their outer edges. An expansion panel is affixed near and extends between the inner edges. The inner edges are selectively joined directly together along an expansion seam. When the expansion seam is opened, the expansion panel provides additional circumference to the casing for holding larger trees. The outer edge of the first panel is selectively joined to a secondary zipper edge on the second panel, located inwardly of the outer edge of the second panel, to reduce the circumference of the casing.

1 Claim, 10 Drawing Sheets

(56) References Cited

U.S. PATENT DOCUMENTS

| | | | | |
|---|---|---|---|---|
| 5,590,775 | A * | 1/1997 | Moore | A47G 33/045 206/423 |
| 5,911,463 | A * | 6/1999 | Fesko | B65F 1/00 294/152 |
| 7,694,494 | B2 * | 4/2010 | Bornemeier | A47G 33/045 53/389.2 |
| 7,775,360 | B2 * | 8/2010 | Bornemeier | A47G 33/045 206/423 |
| 8,075,185 | B2 * | 12/2011 | Hecht | A47G 33/045 280/18 |
| 8,544,922 | B1 * | 10/2013 | Huzar | B60P 7/0876 294/157 |
| 9,215,945 | B2 * | 12/2015 | PeCoy | A47G 33/04 |
| 9,333,978 | B2 * | 5/2016 | Lato | B65D 71/0096 |
| 9,578,814 | B2 * | 2/2017 | Belschner | A01G 13/043 |
| 9,814,188 | B2 * | 11/2017 | Almudhyan | A01G 27/02 |
| 2004/0262183 | A1 * | 12/2004 | Gildart | A45C 11/00 206/423 |
| 2005/0183975 | A1 | 8/2005 | Stein | |
| 2007/0177826 | A1 * | 8/2007 | Schoenig | A45C 13/002 383/4 |
| 2007/0227925 | A1 * | 10/2007 | Westrate | A47G 33/045 206/423 |
| 2008/0257770 | A1 * | 10/2008 | Limber | B62B 1/26 206/423 |
| 2016/0311299 | A1 * | 10/2016 | White | B60J 11/04 |

* cited by examiner

CHRISTMAS TREE DISPOSAL CASING

CROSS REFERENCES AND RELATED SUBJECT MATTER

This application is a non-provisional filing of provisional patent application Ser. No. 62/426,792, filed in the United States Patent Office on Nov. 28, 2016, from which priority is claimed and which is incorporated herein by reference in its entirety.

TECHNICAL FIELD

The present disclosure relates generally to a tree disposal casing. More particularly, the present disclosure relates to a system that allows for easy and mess-free removal of a Christmas tree.

BACKGROUND

A live Christmas tree can be a treasure to be enjoyed by the whole family throughout the holiday season. By the time the holiday season is over, when it is time to dispose of the tree, typically the tree will have already dried significantly. As the tree dries, the needles and branches become more brittle. Consequently, they easily break free of the tree as it is being handled for disposal. Literally thousands of needles can fall off the tree while it is being carried out. Thus, while it might take only five minutes to remove the tree, the subsequent cleanup from the removal operation can last for hours.

In addition to the mess, it is easy to underestimate the weight and bulk of larger Christmas trees. When it becomes necessary to carry the tree out, it becomes all too clear how unwieldy it can be—especially when one attempts to do this alone.

Various tree disposal bags have been produced and proposed over the years. While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a simple and mess free way of removing a Christmas tree. Accordingly, the present disclosure provides a sleeve that encases the Christmas tree, allowing it to be easily handed and carried out for disposal, while containing needles and other potential mess.

It is another aspect of an example embodiment in the present disclosure to provide a disposal casing that is easy to secure onto a tree. Accordingly, the casing includes a main seam that is selectively secured with a main zipper, and is selectively separable so that the casing may be substantially laid flat. Once the tree is positioned longitudinally along the casing, the main zipper is secured to create a sleeve that encases the tree.

It is yet another aspect of an example embodiment in the present disclosure to provide a casing that effectively contains the tree, its branches, needles, and associated debris while the tree is disposed of. Accordingly, an upper end of the casing and a lower end of the casing each have a draw string assembly for cinching the casing.

It is a further aspect of an example embodiment in the present disclosure to provide a casing that can accommodate trees of various sizes. Accordingly, the casing has an expansion panel that is configured to expand the casing transversely through an expansion seam having an expansion zipper. When the expansion zipper is opened, the casing expands transversely to increase in maximum circumference by the width of the expansion panel. In addition, the main zipper is configured for optional attachment to a secondary zipper edge to selectively reduce the circumference of the casing for use with smaller trees.

It is a still further aspect of an example embodiment in the present disclosure to provide a casing that is easy to carry, even by several people when necessary for disposal of large trees. Accordingly, several handles are provided on the casing, and are conveniently located thereon, for facilitating convenient hauling of the tree while encased therein.

Accordingly, the present disclosure describes a Christmas tree disposal casing, having an upper end and a lower end, and a first panel and a second panel that each have an inner edge, an outer edge, an upper edge, and a lower edge. The casing has a flat configuration and also has a sleeve configuration for encasing a tree therein when the first panel is joined to the second panel at or near their outer edges. An expansion panel is affixed near and extends between the inner edges. The inner edges are selectively joined directly together along an expansion seam. When the expansion seam is opened, the expansion panel provides additional circumference to the casing for holding larger trees. The outer edge of the first panel is selectively joined to a secondary zipper edge on the second panel, located inwardly of the outer edge of the second panel, to reduce the circumference of the casing.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
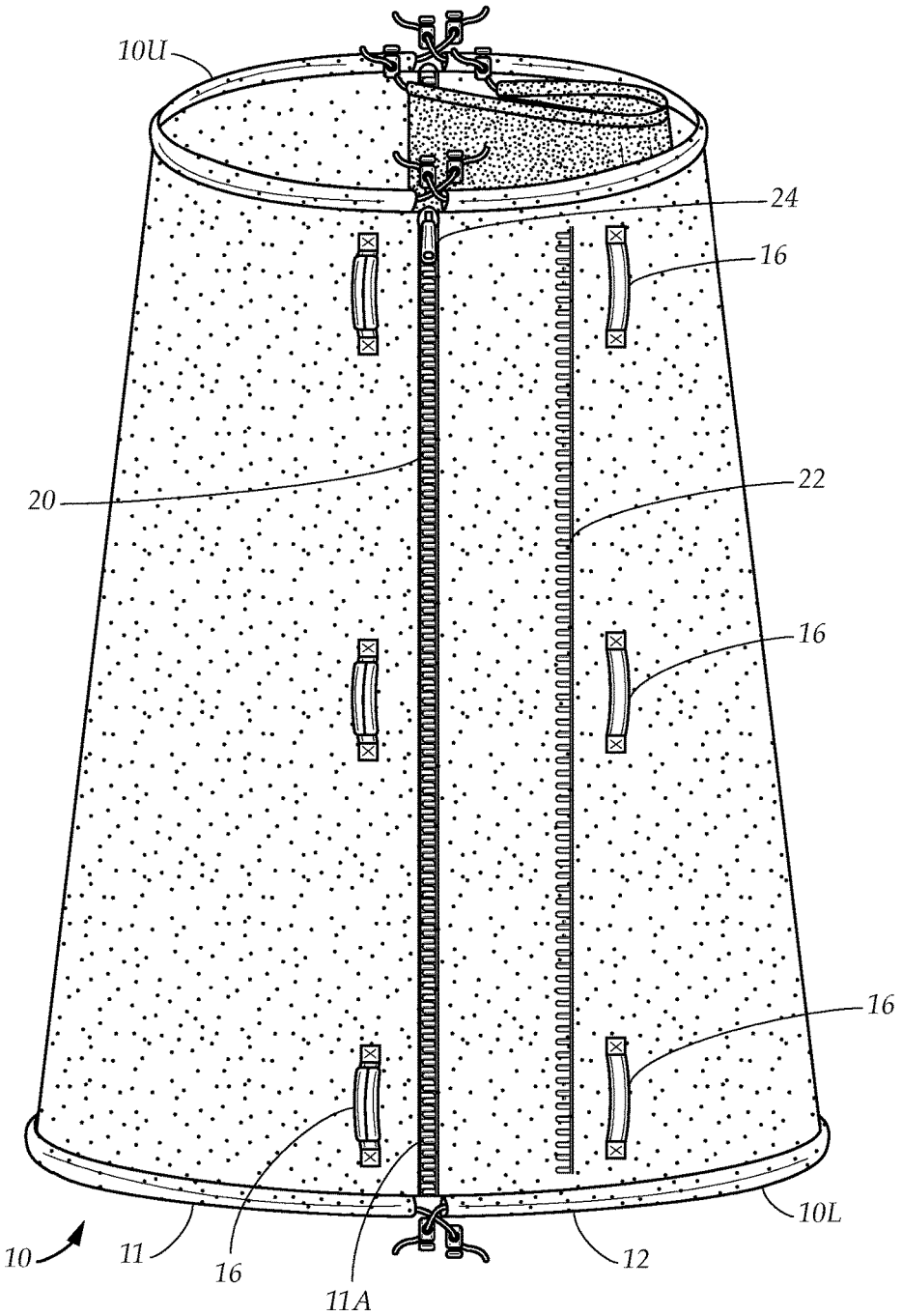
FIG. 1 is diagrammatic perspective view, showing the casing in a sleeve configuration, wherein the main seam is secured with the main zipper.

FIG. 1 illustrates a tree casing 10 having an upper end 10U and a lower end 10L. The tree casing 10 is shown in a sleeve configuration wherein a tubular sleeve is formed between the upper end 10U and lower end 10L. As illustrated, the casing 10 is generally cylindrical but may be tapered to flare from the upper end 10U toward the lower end 10L, such that the lower end 10L is somewhat larger in circumference. The tree casing 10 includes a main seam 20, which is fastened by a main zipper 24 when the tree casing 10 is in its sleeve configuration.

Figure 2:
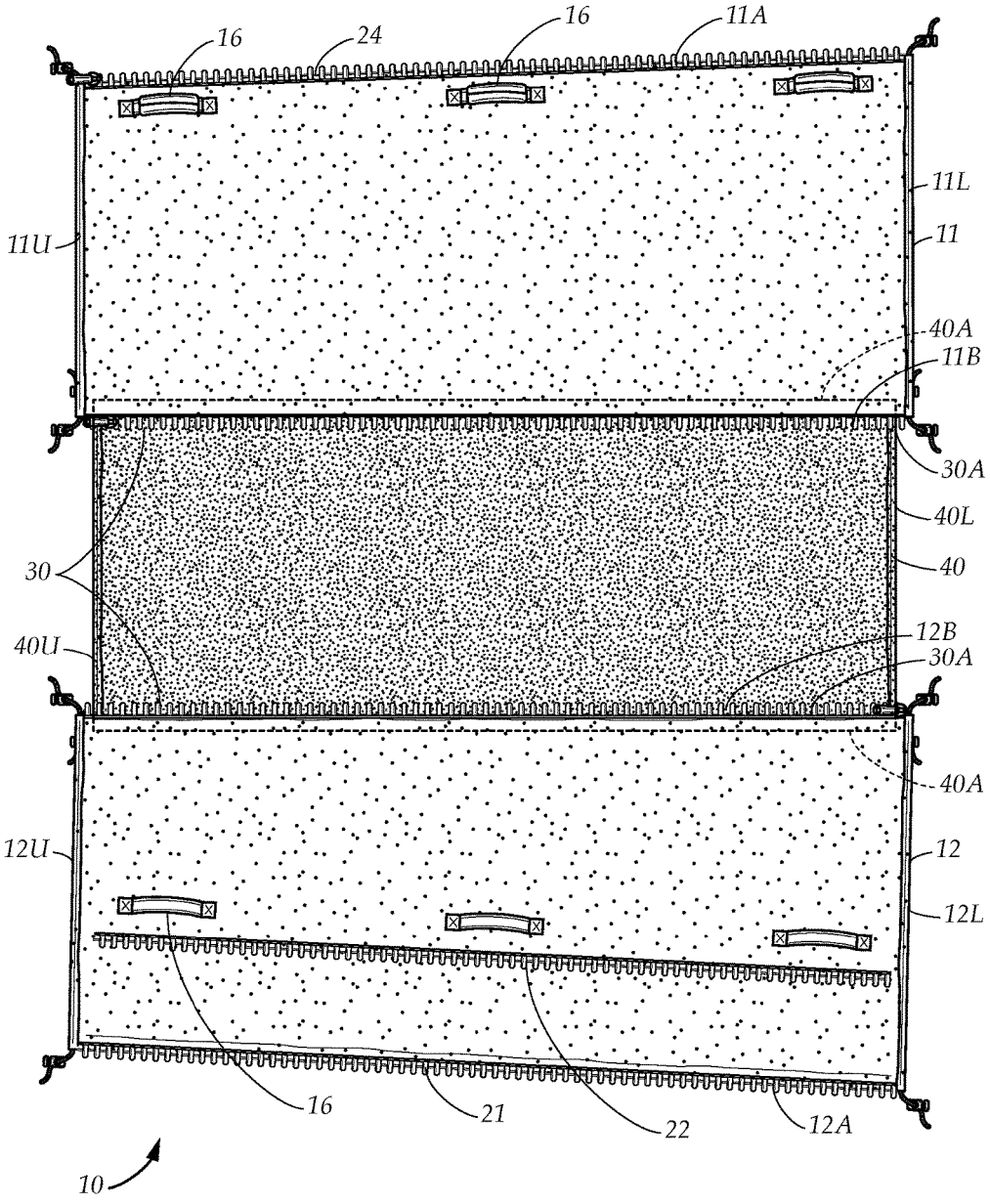
FIG. 2 is a top plan view, showing the casing in a flat configuration wherein the expansion seam is open.

Referring to FIG. 2, the tree casing 10 is in a flat configuration. In addition, the tree casing 10 has an expansion seam 30, which is open in FIG. 2 and is spanned by an expansion panel 40. In particular the tree casing 10 is constructed substantially from fabric panels, including a first panel 11 and a second panel 12. The first panel 11 has an outer edge 11A and an inner edge 11B. The second panel 12 has an outer edge 12A and an inner edge 12B.

Figure 5A:
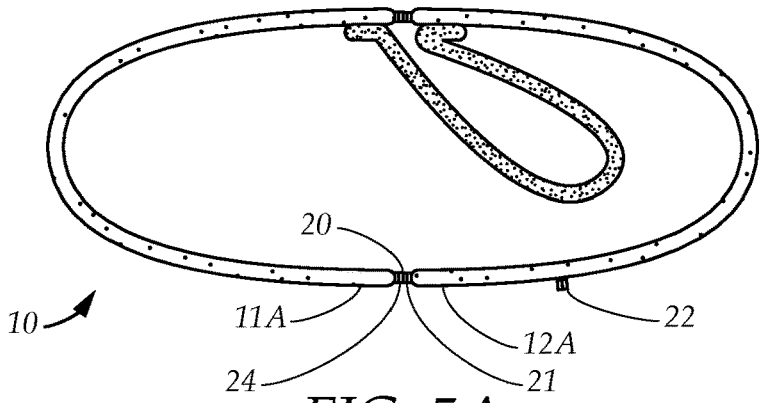
FIG. 5A is a side elevational view of the casing in its sleeve configuration, wherein the expansion seam is closed, and the main zipper is attached to the primary zipper edge.
Figure 5B:
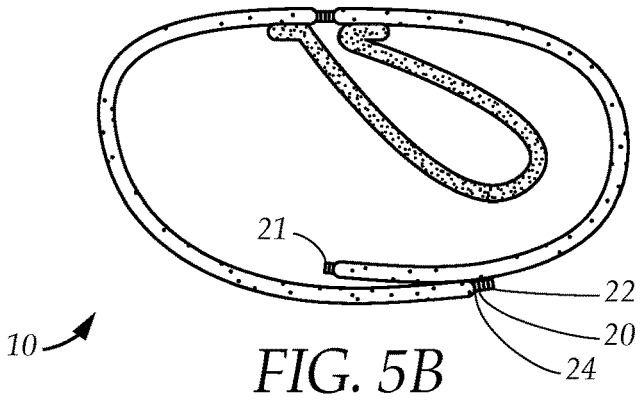
FIG. 5B is a side elevational view of the casing in its sleeve configuration, similar to FIG. 5A wherein the expansion seam is closed, but wherein the main zipper is attached to the secondary zipper edge for minimum circumference.
Figure 5C:
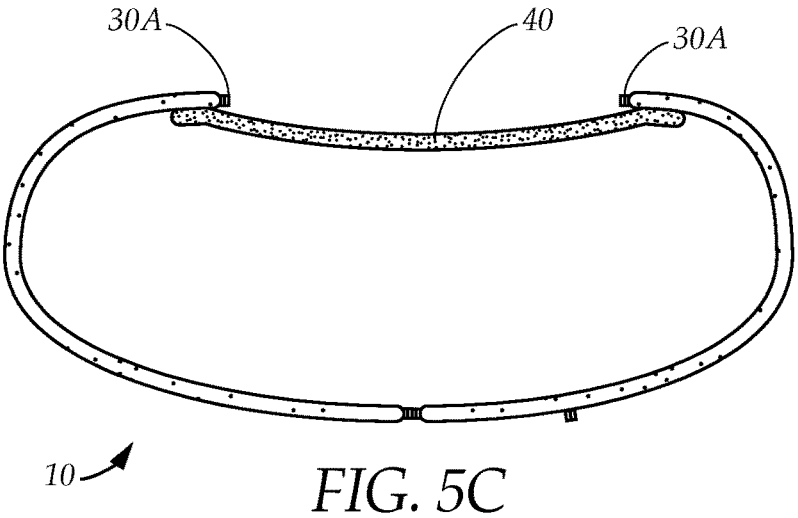
FIG. 5C is a side elevational view of the casing in its sleeve configuration, wherein the expansion seam is open and the main zipper is attached to the primary zipper edge for maximum circumference.

The outer edges 11A, 12A of the first panel 11 and second panel 12 may be mated together to form the main seam 20 (seen in FIG. 1 and also seen in FIGS. 5A and 5C). Accordingly, the outer edge 11A of the first panel 11 has the main zipper 24, and the outer edge 12A of the second panel 12 has a primary zipper edge 21. Referring again to FIG. 2, the second panel 12 also has a secondary zipper edge 22, extending substantially parallel to the primary zipper edge 21, but located further inwardly from the outer edge 12A of the second panel 12. The secondary zipper edge 22 can alternatively be mated with the main zipper 24 to form the main seam 20 (as seen in FIG. 5B), and thereby put the casing 10 in its sleeve configuration but with a somewhat smaller circumference—in particular, smaller by the distance between the primary zipper edge 21 and the secondary zipper edge 22.

Figure 2A:
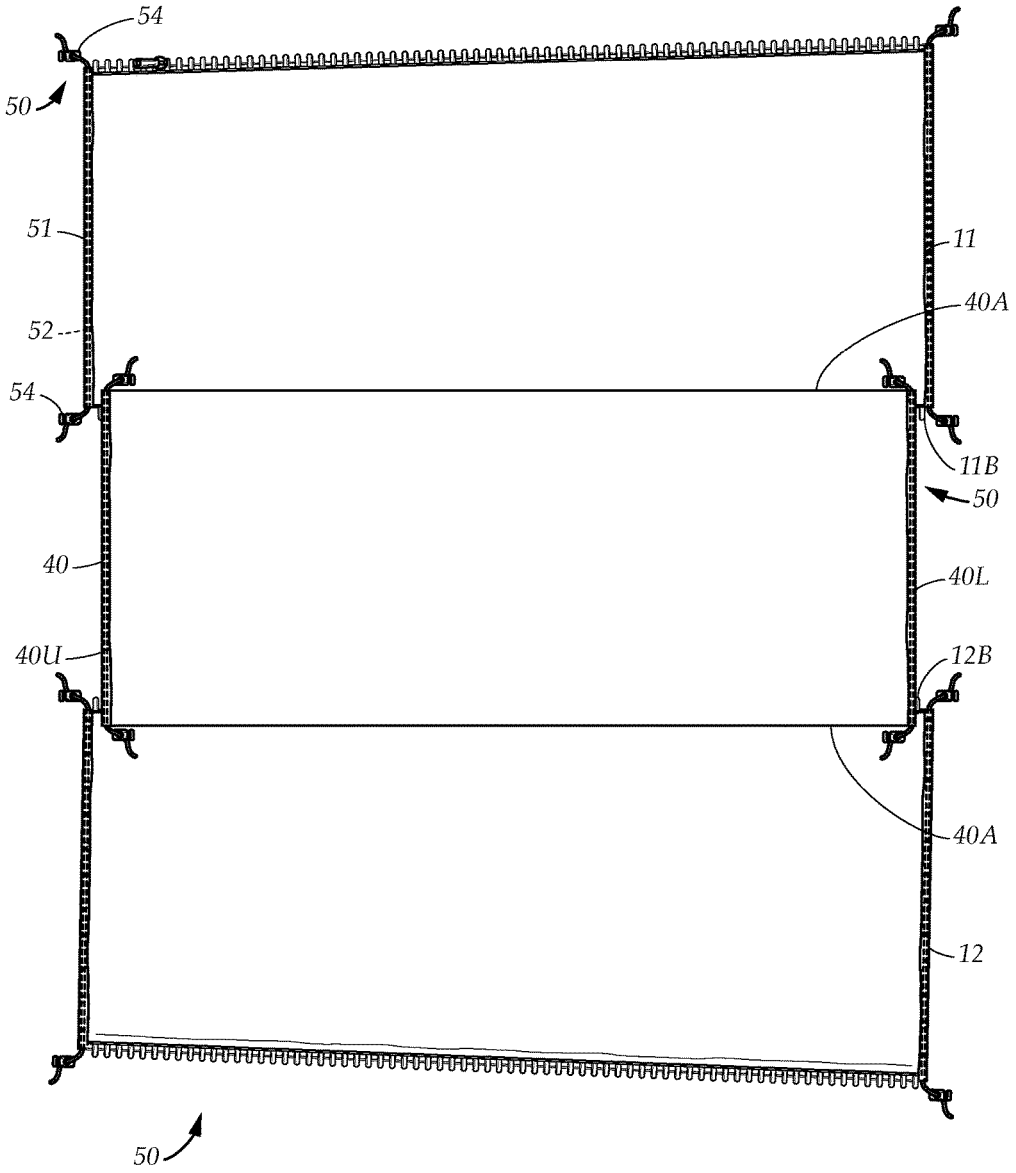
FIG. 2A is a bottom plan view, similar to FIG. 2, wherein structural details have been simplified to show the draw string assemblies.

Referring to FIG. 2, the first panel 11 and second panel 12 each have an upper edge 11U, 12U, and a lower edge 11L and 12L. The expansion panel 40 has an upper edge 40U and a lower edge 40L. Referring to FIG. 2A, several draw string assemblies 50 are provided, at each of the upper edges 11U, 12U, 40U, and lower edges 11L, 12L, 40L, to cinch or shorten these edges, as appropriate. Each draw string assembly 50 includes a channel 51 that extends along one of said upper edges 11U, 12U, 40U or lower edges 11L, 12L, 40L. Each draw string assembly 50 further includes a string 52 having a pair of ends, and a pair of end holds 54 affixed to the ends of the string 52.

Referring again to FIG. 2 and FIG. 2A, the expansion panel 40 has a pair of expansion panel outer edges 40A, which are secured to the first panel 11 and second panel 12, near their inner edges 11B, 12B. The upper edge 40U and a lower edge 40L of the expansion panel 40 define an expansion panel width. Accordingly, the expansion panel 40 can increase the circumference of the casing 10 in its sleeve configuration by the width of the expansion panel 40, as seen in FIG. 5C. The expansion seam 30 includes expansion zipper edges 30A that are selectively joined as illustrated in FIG. 3 and FIG. 4 to contract the sleeve and are selectively opened or unfastened to expand the sleeve.

Figure 3:
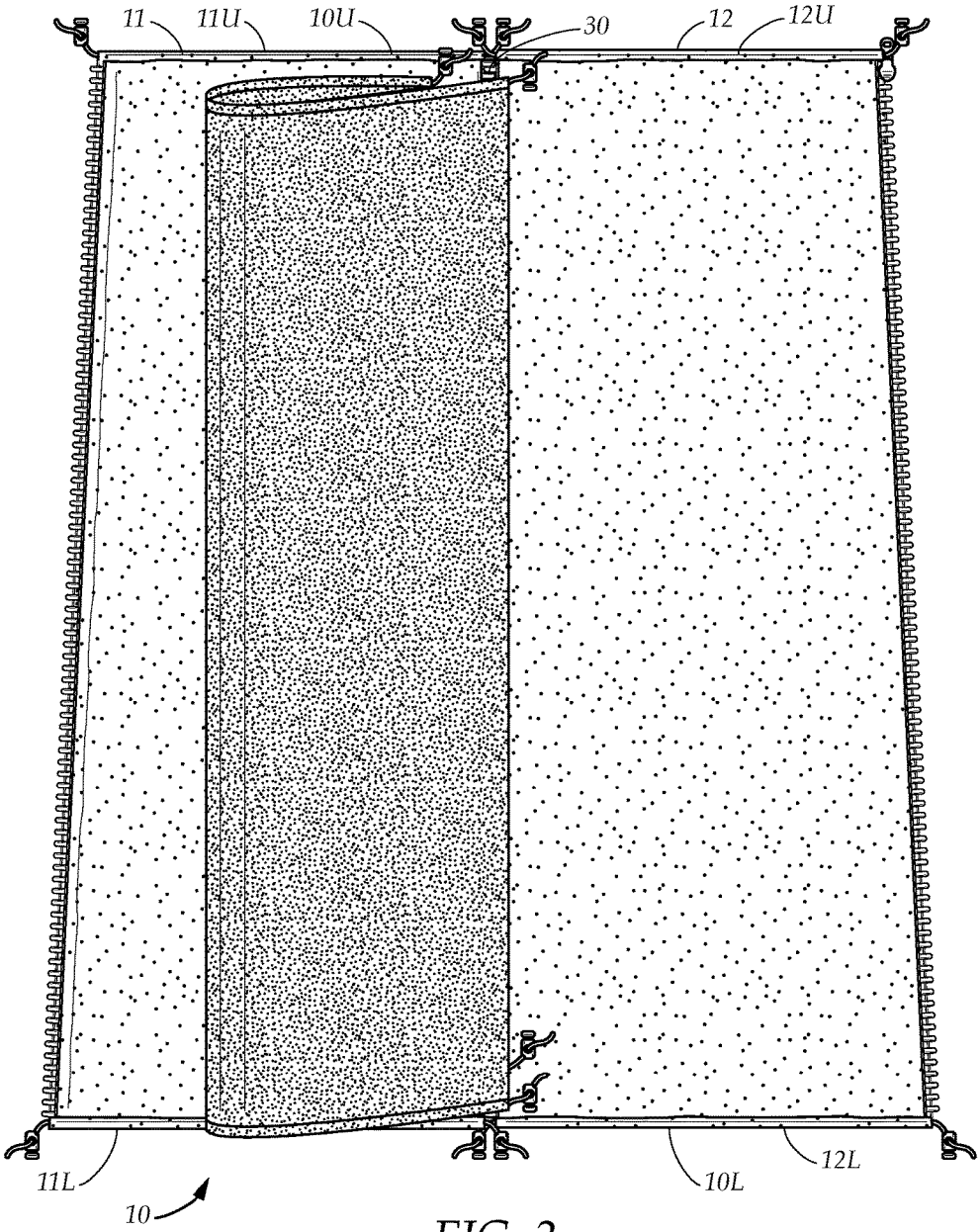
FIG. 3 is a bottom plan view, similar to FIG. 2A except rotated, and wherein the expansion seam is closed to decrease circumference of the casing when it is put in its sleeve configuration.
Figure 4:
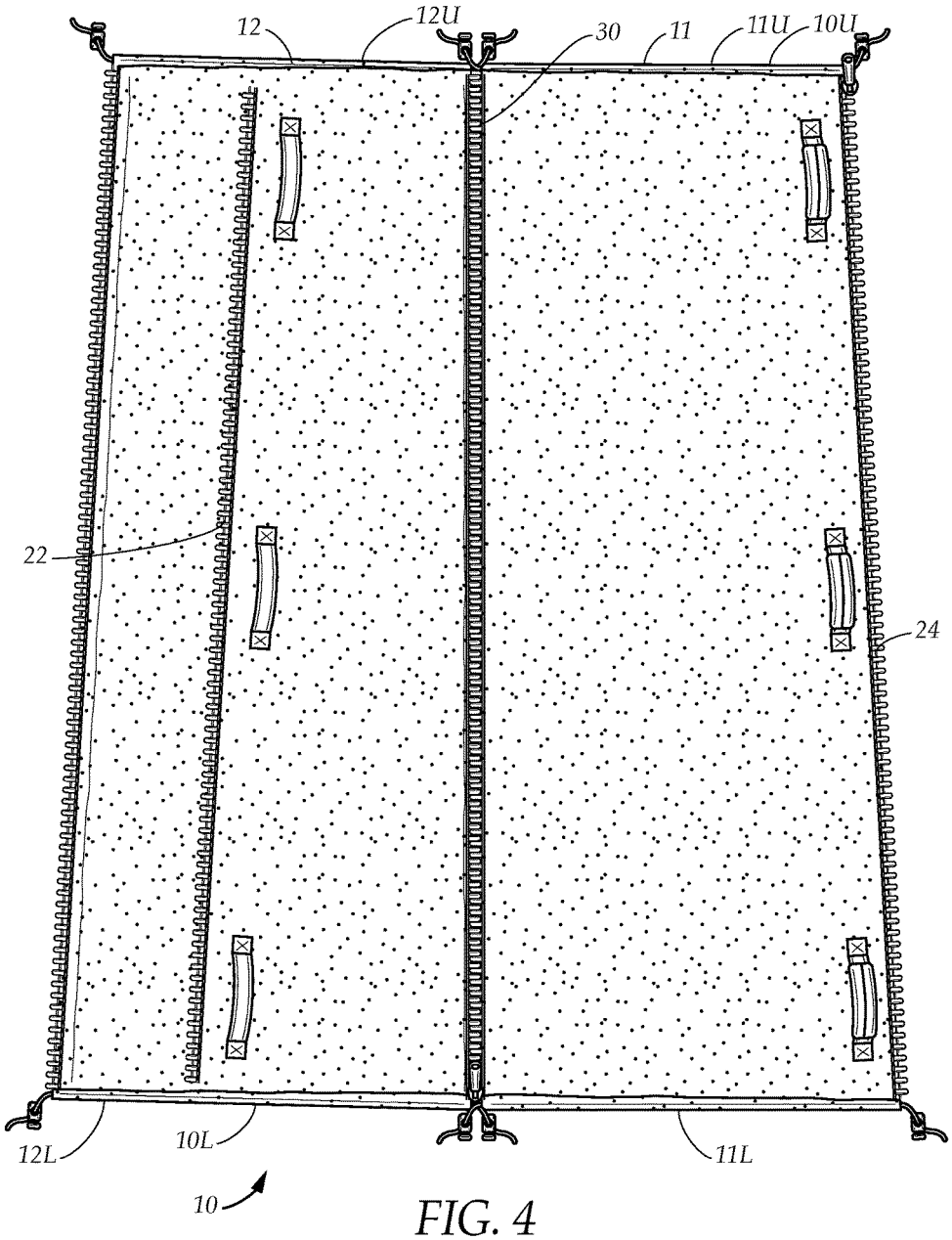
FIG. 4 is a top plan view of the casing in the configuration shown in FIG. 3.

Referring to FIG. 3 and FIG. 4, the inner edges 11B, 12B of the first panel 11 and second panel 12 may be mated together to join or close the expansion seam 30. In this configuration, the maximum circumference of the casing at its upper end 10U is determined by the combined upper edges 11U and 12U, and at the lower end 10L by the combined lower edges 11L and 12L. Note that the actual circumference of the sleeve can be reduced by fastening the main zipper 24 to the secondary zipper edge 22, thereby reducing the effective length of the upper edge 12U and lower edge 12L of the second panel 12.

Referring again to FIG. 1 and FIG. 2, the casing has handles 16 secured to the first panel 11 and second panel 12. The handles 16 are configured to allow the casing to be comfortably carried by several people while hauling the tree for disposal. The handles are preferably provided adjacent to the main seam 20. Accordingly, the handles are provided in a linear grouping along the outer edge 11A of the first panel 11, and in a linear grouping along the secondary zipper edge 22 of the second panel 12. Preferably three handles 16 are provided in each linear grouping, extending between the upper end 10U and lower end 10L. In particular, one handle 16 is near the upper end 10U of the casing 10, another handle 16 near the lower end 10L of the casing 10, and the third handle 16 substantially midway therebetween.

Figure 6A:
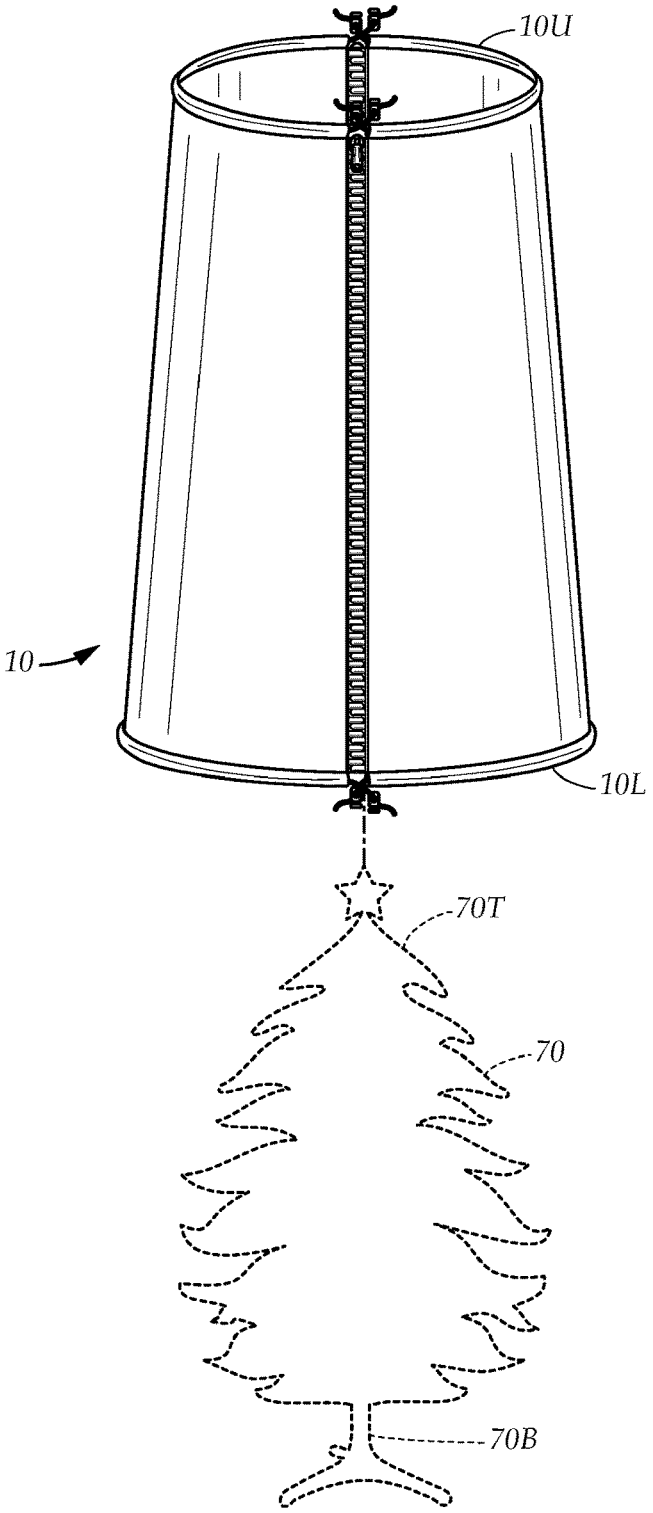
FIG. 6A is a diagrammatic perspective view of the casing positioned proximate to a Christmas tree.
Figure 6B:
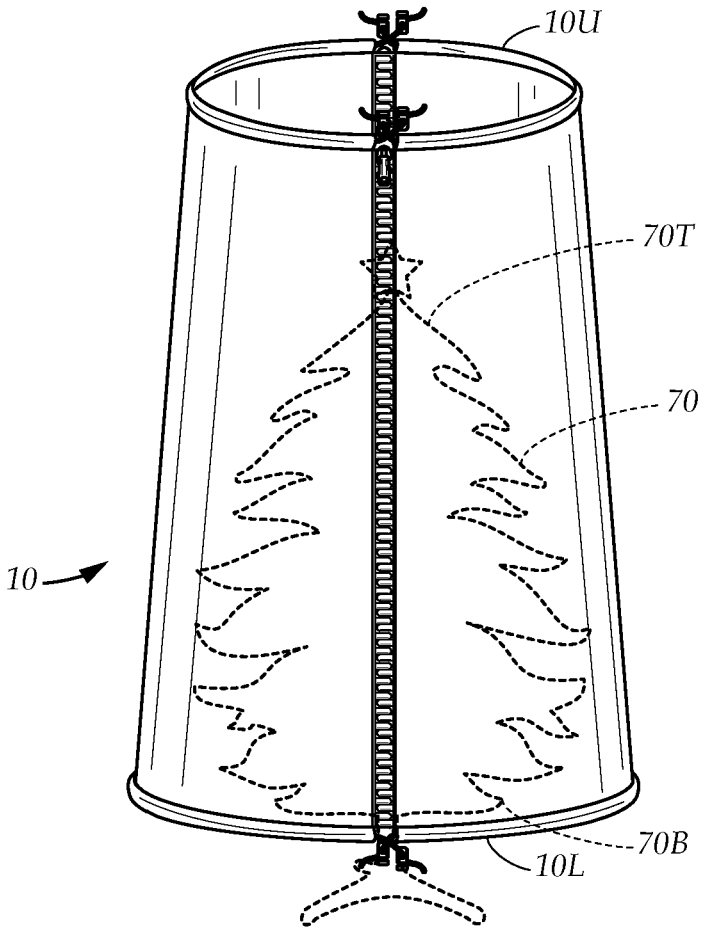
FIG. 6B is a diagrammatic perspective view of the Christmas tree extending within the casing.
Figure 6C:
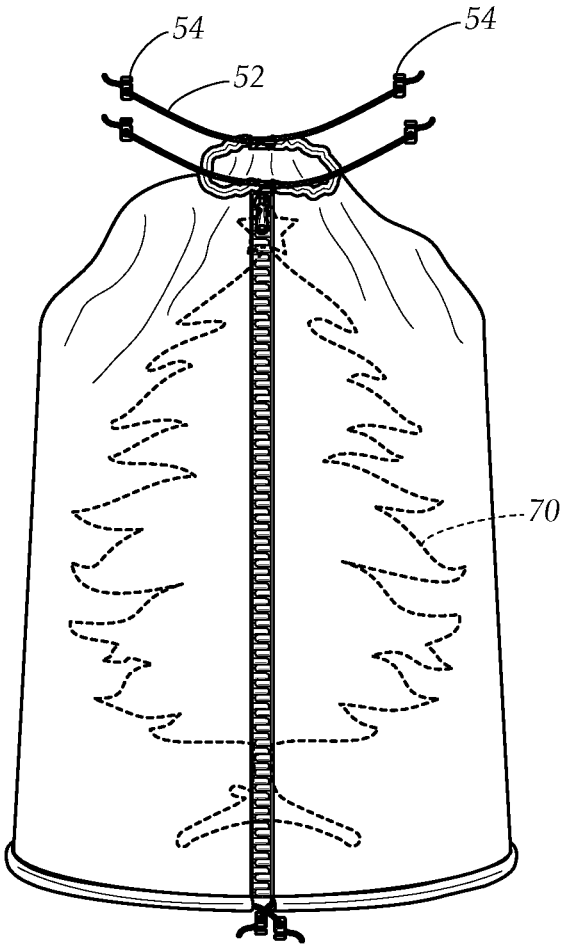
FIG. 6C is a diagrammatic perspective view, illustrating the casing being cinched using the draw string assemblies at the upper end.
Figure 6D:
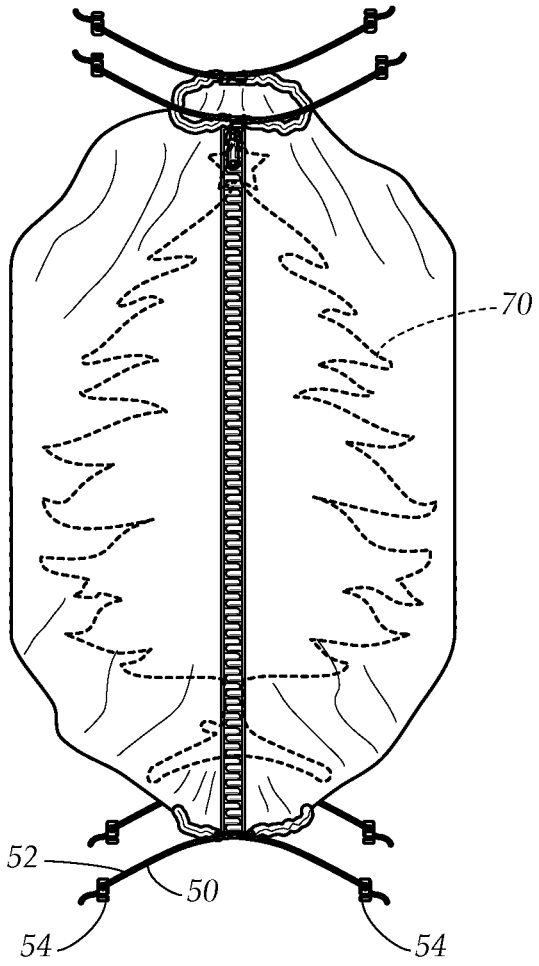
FIG. 6D is a diagrammatic perspective view, illustrating the casing being cinched using the draw string assemblies at the lower end.

FIG. 6A illustrates a Christmas tree 70 in conjunction with the casing 10. The Christmas tree 70 has a top 70T and a bottom 70B, thereby defining a height of the tree. The casing preferably has a length, as defined between its upper end 10U and lower end 10L that is equal to or greater than the tree height. Referring then to FIG. 6B, the tree 70 is positioned within the casing 10, with the bottom 70B of the tree 70 toward the lower end 10L of the casing 10 and the top 70T toward the upper end 10U of the casing. Note that positioning the tree within the casing 10 as indicated may be accomplished by putting the casing in its flat configuration upon a floor or ground surface near the tree with the upper edges 11U, 12U aligned and lower edges 11L, 12L aligned (as in FIG. 2, FIG. 2A, or FIG. 3), laying the tree longitudinally onto the casing between the upper and lower ends thereof, and then securing the main zipper to bring the casing into its sleeve configuration while encasing the tree. Referring to FIG. 6C and FIG. 6D, once the tree 70 is fully within the casing 10, the end holds 54 of each string 52 of each of the draw string assemblies 50 at the upper end 10U and lower end 10L of the casing 10 are pulled to cinch the casing thereat to enclose the tree 70 and prevent debris spillage while disposing of the tree.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a tree disposal casing. The disclosure is illustrated by example in the drawing figures, and throughout the written description. It should be understood that numerous variations are possible, while adhering to the inventive concept. Such variations are contemplated as being a part of the present disclosure.

What is claimed is:

1. A tree disposal casing, having an upper end and a lower end, comprising:

a first panel having an inner edge, an outer edge, an upper edge, and a lower edge, the first panel has a main zipper along the outer edge;

a second panel having an inner edge, an outer edge, an upper edge, and a lower edge, the second panel has a primary zipper edge along the outer edge and a secondary zipper edge extending substantially parallel to the primary zipper edge but located inwardly from the outer edge;

an expansion panel having a pair of expansion panel outer edges, one of the expansion panel outer edges is attached to the inner edge of the first panel and the other of the expansion panel outer edges is attached to the inner edge of the second panel; and wherein the first panel and second panel are selectively joined together along their outer edges by mating one of the primary zipper edge and the secondary zipper edge to the main zipper to form a sleeve for encasing a tree therein;

further having an expansion seam formed by a pair of expansion zipper edges, one of the pair of expansion zipper edges located along the inner edge of the first panel and the other of the pair of expansion zipper edges located along the inner edge of the second panel, wherein the sleeve is contracted by joining of the inner edge of the first panel and the sleeve is expanded by unjoining the inner edges and spanning between the inner edges of the first panel and second panel with the expansion panel;

wherein the expansion panel has an upper edge, a lower edge, and an expansion panel width between the expansion panel outer edges; and further comprising a plurality of draw string assemblies, one of the draw string assemblies are located at each upper edge and lower edge of the first panel, second panel, and expansion panel;

further comprising at least one handle attached to the first panel and at least one handle attached to the second panel;

wherein the casing is generally cylindrical and is also tapered to flare from the upper end toward the lower end, such that the sleeve is larger in circumference at the lower end than at the upper end; and wherein the at least one handle attached to the first panel further comprises three handles arranged in a straight line extending between the upper edge and lower edge of the first panel.

* * * * *